US006942487B2

(12) United States Patent
Corbalis

(10) Patent No.: US 6,942,487 B2
(45) Date of Patent: Sep. 13, 2005

(54) SKATEBOARD TRICK MASTER AND AMUSEMENT DEVICE

(76) Inventor: Keith Corbalis, 2610 Davis Dr., Tustin, CA (US) 92782

( * ) Notice: Subject to any disclaimer, the term of this patent is extended or adjusted under 35 U.S.C. 154(b) by 0 days.

(21) Appl. No.: 10/762,716

(22) Filed: Jan. 22, 2004

(65) Prior Publication Data

US 2004/0198507 A1 Oct. 7, 2004

Related U.S. Application Data

(60) Provisional application No. 60/441,711, filed on Jan. 23, 2003.

(51) Int. Cl.[7] ..... A63B 69/16

(52) U.S. Cl. ..... 434/247; 482/69; 482/71; 280/818; 280/87.042; 472/91

(58) Field of Search ..... 434/247, 253; 482/69, 70, 71; 280/809, 816, 818, 87.041, 87.042, 87.05; 472/89, 91

(56) References Cited

U.S. PATENT DOCUMENTS

| | | | | | |
|---|---|---|---|---|---|
| 2,941,801 | A | | 6/1960 | Pedersen | |
| 3,024,021 | A | | 3/1962 | Coplin et al. | |
| 3,591,172 | A | * | 7/1971 | Hude | 482/71 |
| 3,995,852 | A | | 12/1976 | Mendelson | |
| 4,491,318 | A | | 1/1985 | Francke | |
| 4,705,272 | A | | 11/1987 | Rupprecht | |
| 4,787,630 | A | * | 11/1988 | Watson et al. | 482/146 |
| 4,966,364 | A | | 10/1990 | Eggenberger | |
| 5,062,629 | A | | 11/1991 | Vaughan | |
| 5,080,382 | A | | 1/1992 | Franz | |
| 5,192,258 | A | | 3/1993 | Keller | |
| 5,399,140 | A | | 3/1995 | Klippel | |
| 5,499,949 | A | * | 3/1996 | Heubl | 472/105 |
| 5,509,871 | A | | 4/1996 | Giovanni | |
| 5,582,567 | A | * | 12/1996 | Chang | 482/146 |
| 5,690,383 | A | * | 11/1997 | Meeker | 297/274 |
| 5,795,277 | A | | 8/1998 | Bruntmyer | |
| 5,876,311 | A | * | 3/1999 | Coates et al. | 482/77 |
| 5,895,340 | A | | 4/1999 | Keller | |
| 5,897,474 | A | | 4/1999 | Romero | |
| 6,017,297 | A | | 1/2000 | Collins | |
| 6,019,712 | A | | 2/2000 | Duncan | |
| 6,196,558 | B1 | | 3/2001 | Simon | |
| 6,264,569 | B1 | * | 7/2001 | Cannavino | 472/95 |
| 6,368,112 | B1 | * | 4/2002 | Mason | 434/253 |
| 6,413,197 | B2 | | 7/2002 | McKechnie et al. | |
| 6,419,586 | B1 | | 7/2002 | Chiu | |
| 6,554,747 | B1 | * | 4/2003 | Rempe | 482/38 |
| 6,599,198 | B2 | * | 7/2003 | Ettenhofer | 472/104 |
| 2002/0140208 | A1 | | 10/2002 | Duvall | |
| 2002/0163144 | A1 | | 11/2002 | Guerra | |

* cited by examiner

*Primary Examiner*—Kien Nguyen
(74) *Attorney, Agent, or Firm*—Knobbe, Martens, Olson & Bear, LLP

(57) ABSTRACT

A device for mastering skate board tricks and maneuvers comprises a frame. The frame has a top and the frame is adapted to rest on a support surface. A spring board is suspended from the frame by stretchable straps. A foot deck is rotationally secured to the spring board and is secured to the spring board to limit or eliminate relative vertical motion between the spring board and the foot board.

8 Claims, 9 Drawing Sheets

SKATEBOARD TRICK MASTER AND AMUSEMENT DEVICE

RELATED APPLICATIONS

This application claims the priority benefit under 35 U.S.C. §119(e) of U.S. Provisional Patent Application No. 60/441,711, filed on Jan. 23, 2003, which is hereby incorporated by reference in its entirety.

BACKGROUND OF THE INVENTION

1. Field of the Invention

The present invention generally relates to amusement devices. More particularly, the present invention relates to amusement devices where users may more easily learn, practice, and master skateboard maneuvers and tricks.

2. Description of the Related Art

New skateboard users desire to quickly learn and master skateboard tricks and maneuvers; however, using a skateboard poses many challenges to a first time user. For instance, the user must develop basic skills in order to competently control and articulate a rolling, tilting and turning skateboard deck. In addition, the user must then develop skills that will allow them to spring the board, which causes the board to lift off of the ground. Furthermore, the user must develop the coordination and balance skills required to pitch the board on one truck, which allows the user to rotate the skateboard in a controlled manner. Combining all of these complex movements of a skateboard simultaneously while a user is on the skateboard makes mastering skateboard tricks difficult.

As with many sports, practicing motions specific to the given sport provides a means to improve and master skills required in that sport. Given the complexities of the skills and maneuvers required for skateboarding, having a method to practice the motions in a simplified, stabilized or isolated way improves developing the fundamental skills to master maneuvers and tricks.

Various attempts have been made to design devices that might facilitate skateboard skill mastery. These devices suffer from design flaws that reduce the transferability of skills learned on the devices to actual skateboard use or that significantly reduce the number of skills that can be learned on the devices.

In one arrangement of a device a skateboard deck has been provided with a large coil spring attached to the center of the bottom of the foot deck. In this device, the spring provides a lifting force to the foot deck to allow a user to learn tricks and maneuvers. However, the device rests on the bottom of the coil spring and allows the device to tip and tilt in any direction. Such a configuration is adequate for more experienced skateboard users; however, beginning skateboard users would benefit from a device that provides a stable non-tilting platform.

SUMMARY OF THE INVENTION

Accordingly, a skateboard training device is desired that offers a skateboard deck. The skateboard deck preferably can rotate on a rotational bearing system at a center region of the foot deck. Moreover, the device preferably provides an upward force while the foot deck is grounded such that the force can lifts the foot deck when the user unloads their weight. Furthermore, the device preferably simulates a skateboard geometry to simulate the pitching motion of a skate board and allows learning of proper foot placements on the skateboard deck. In addition, the device preferably limits or eliminates the ability to induce side to side tilting motion of a skate board deck in order to facilitate learning of balance and coordination skills necessary for skateboard tricks and maneuvers.

One aspect of an embodiment of the present invention involves a device for mastering skate board tricks and maneuvers. The device comprises a frame. The frame comprises a top and the frame is adapted to rest on a support surface. At least three elastic cords are attached to the frame. The at least three elastic cords are connected to a spring board deck such that the spring board deck is suspended above the support surface and below the top of the frame. A rotational bearing system is secured to the spring board deck and a foot deck is secured to the the rotational bearing system such that the foot deck is capable of rotational movement relative to the spring board deck and the foot deck is secured against substantial vertical movement relative to the spring board deck.

Another aspect of an embodiment of the present invention involves a skateboard training device. The device comprises a frame. At least three resilient cables are secured to the frame. A spring board deck is secured to the at least three resilient cables. A foot deck is rotatably attached to the spring board deck.

BRIEF DESCRIPTION OF THE DRAWINGS

These and other features, aspects and advantages of the present invention will now be described with reference to the drawings of several preferred embodiments, which embodiments are intended to illustrate and not to limit the invention. The drawings consist of 16 figures.

DETAILED DESCRIPTION OF THE PREFERRED EMBODIMENT

Figure 1:
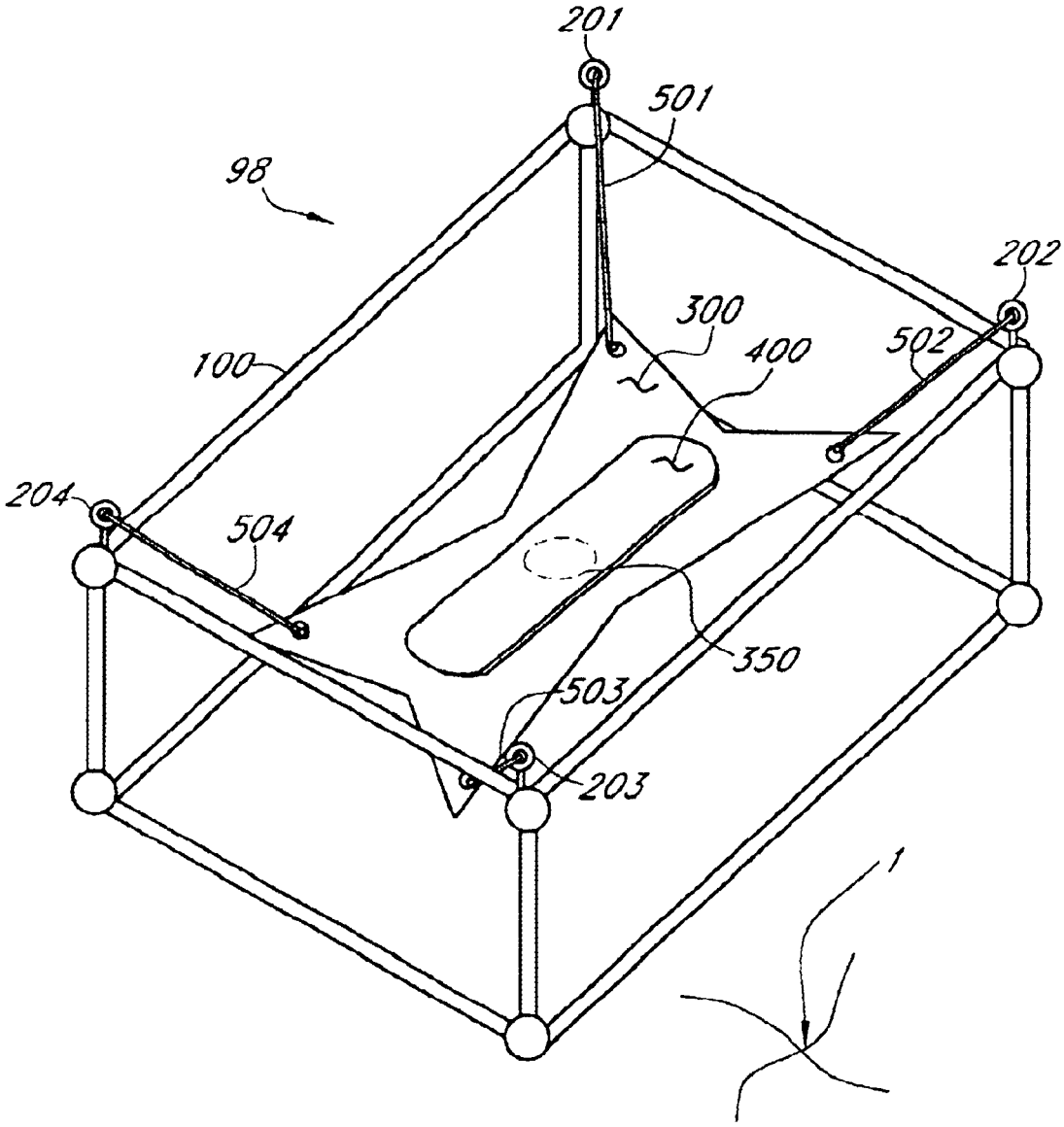
FIG. 1 is a top perspective view of an embodiment of a training device having certain features, aspects and advantages of the present invention.
Figure 2:
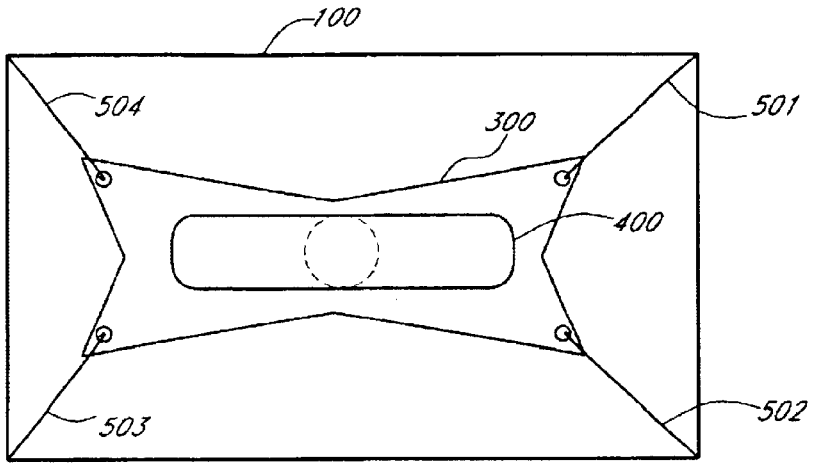
FIG. 2 is a top plan view of the device of FIG. 1.

With reference initially to FIG. 1, a training device 98 having certain features, aspects and advantage of the present invention is illustrated in perspective view. The device 98 comprises a frame 100. The illustrated frame 100 comprises a box frame of sturdy construction to support the user's weight and use of the device 98. A collapsible frame is shown in FIGS. 10 through 13 and is discussed in greater detail below.

Figure 5:
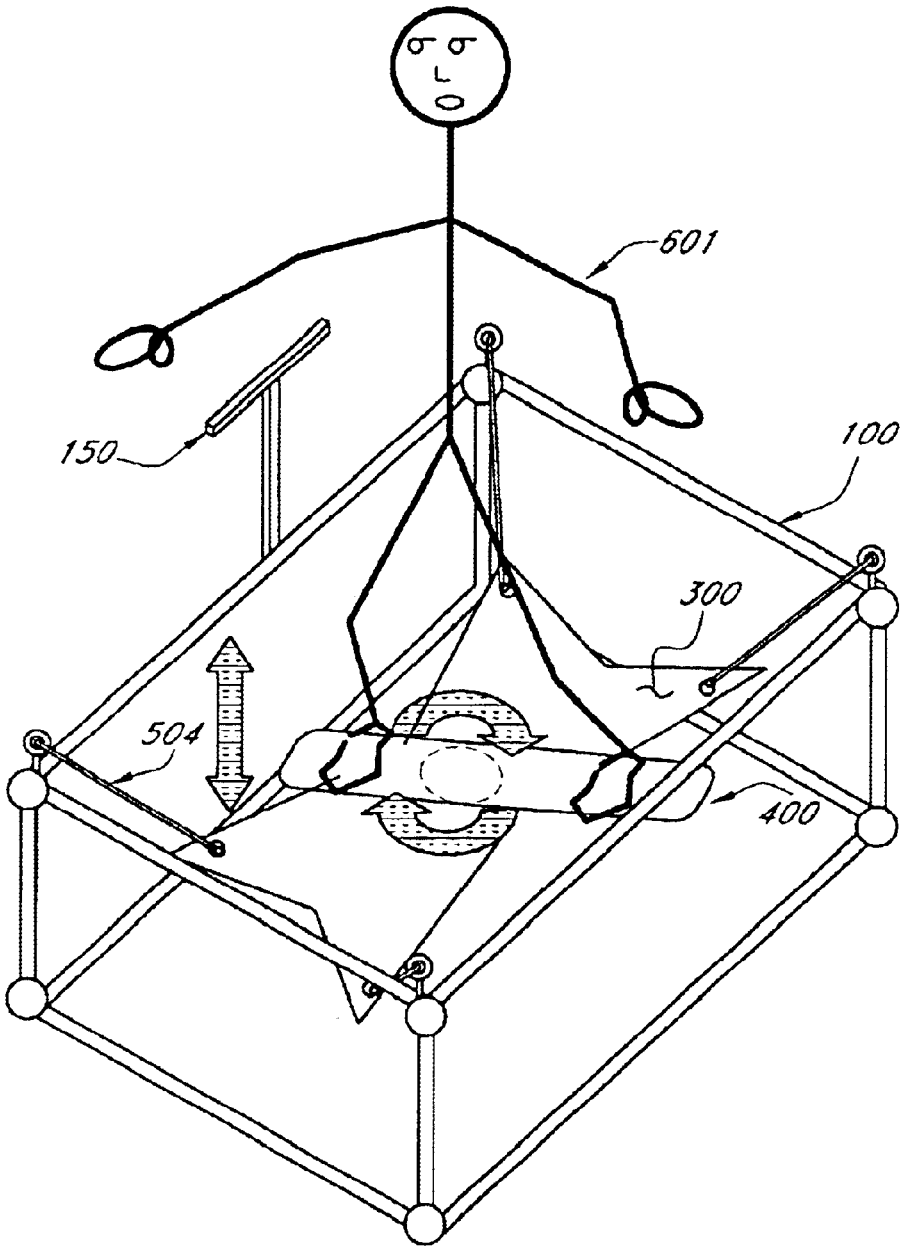
FIG. 5 is a perspective view of the device of FIG. 1 in use.

With continued reference to FIG. 1, the frame 100 preferably rests on level ground 1. In some arrangements, leveling feet (not shown) can be provided and can be attached to the frame 100 in any suitable manner. With reference to FIG. 5, for instance, the frame 100 can comprise a handlebar 150. The handlebar can extend upward from a portion of the frame assembly. Preferably, the handlebar comprises handgrips that are positioned at a height that makes the handgrips easy to hold when using the device. Furthermore, in some embodiments, the handlebar height may be adjustable. In some embodiments, the handlebar 150 can substantially encircle a user 601 such that the handlebar 150 can be easily grasped regardless of the orientation of the user 601. In one embodiment, the frame 100 extends upward a sufficient height that the frame 100 itself can define the handlebar 150. Thus, the user can grasp the handlebar 150 for added stability. For instance, the user can grasp the handlebar 150 when learning to ride a skateboard using the training device 98 or when learning new movements using the training device.

A plurality of anchors 201, 202, 203, 204 are attached to the frame 100 and a plurality of elastic cords 501, 502, 503, 504 are connected to the respective anchors 201, 202, 203, 204 on the frame 100. Preferably, four anchors are provided such that the elastic cords are connected to the frame in four locations. Four anchors provide enough connection points to sufficiently, but not unduly, restrict movement of the platform. In some embodiments, more than four anchors are used and, in other embodiments, less than four anchors are used.

The elastic cords 501–504 are attached to a spring board deck 300 in any suitable manner. In some arrangements having four anchors, two elastic cords can be used. Moreover, in some arrangements one or more than one elastic cord can be used. The elastic cords 501–504 preferably are of a length that allows the spring board deck 300 to be suspended above ground and below the top of the frame 100 when the elastic cords 501–504 are connected to both the frame 100 and the spring board deck 300. Furthermore, the elastic cords 501–504 desirably are of a spring rate and length such that when a user is properly positioned on and supported by the device 98, the spring board deck 300 can touch the ground 1 in a controlled manner.

With continued reference to FIG. 1, the spring board deck 300 can have any suitable configuration. In the illustrated embodiment, the spring board deck 300 is substantially hourglass-shaped in both a lateral and longitudinal direction. In some embodiments, the spring board deck can be generally rectangular, elliptical, ovular, or the like.

A foot deck 400 is mounted to the spring board deck 300. The foot deck 400 preferably defines a skateboard similar. In other words, the foot deck 400 preferably is sized and shaped to mimic a conventional skateboard. Thus, the foot deck 400 is of the similar geometry as a skateboard deck. In the illustrated arrangement, the foot deck 400 is mounted to the spring board deck 300 with a rotational bearing system 350. The rotational bearing system 350 advantageously allows the foot deck 400 to rotate in a clockwise and counterclockwise direction generally within a plane substantially parallel to the plane of the spring board deck 300.

Figure 6:
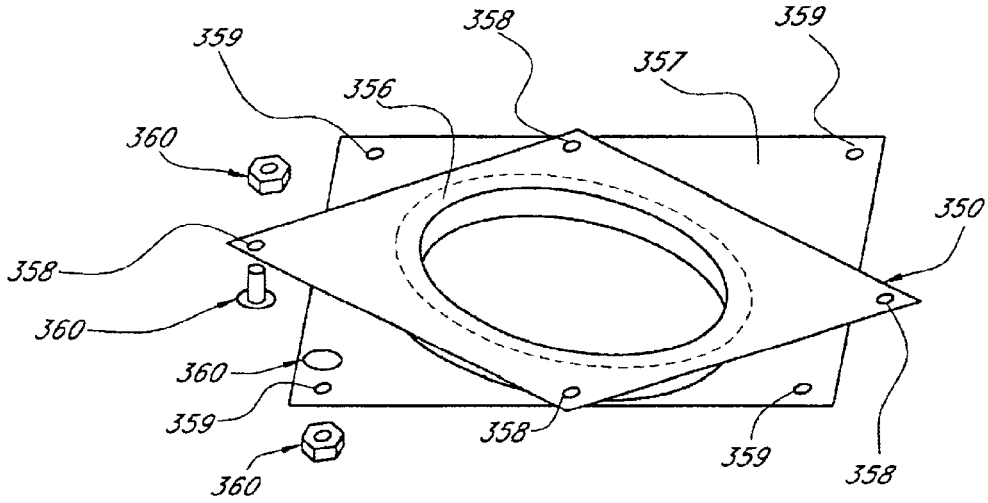
FIG. 6 is a perspective view of a rotational bearing system used to mount a skateboard similar to the balance of the training device of FIG. 1.
Figure 7:
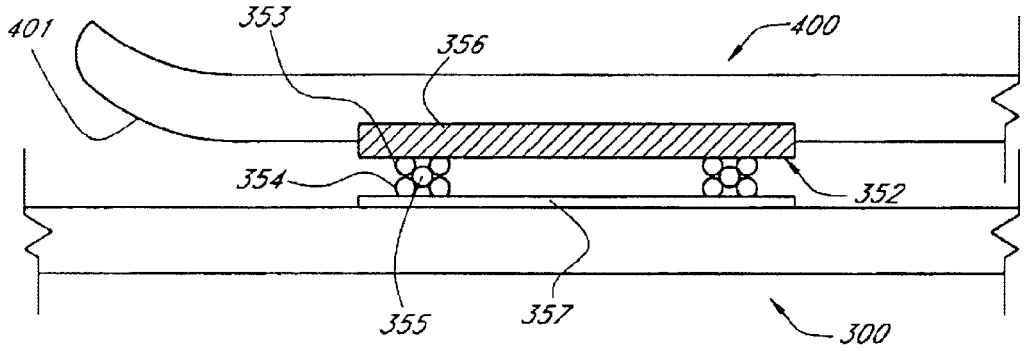
FIG. 7 is a side elevation view of the rotational bearing system of FIG. 6

With reference to FIGS. 6 and 7, the rotational bearing system 350 comprises an adapter 352. The adapter 352 facilitates connection of the foot deck 400 to the rotational bearing system 350. Advantageously, the adapter can be bowed in some embodiments to accommodate the conventional curve of a bottom surface 401 of the foot deck 400 if a conventional skateboard deck is as the foot deck 400. The curve of a conventional skateboard deck could result in asymmetric loads to the rotational bearing system 350 and the adapter 375 provides a more stable attachment of the foot deck 300 to the rotational bearing system 350 notwithstanding the asymmetric loading. The adapter preferably can be secured to a flat surface of the rotational bearing system 350.

The rotational bearing system 350 preferably comprises an upper race 353 and a lower race 354 with bearing balls 355 or the like captured therebetween. In the illustrated arrangement, the upper race 353 is formed on an upper plate 356 while the lower race 354 is formed on a lower plate 357. The upper plate 356 and the lower plate 357 are capable of rotational movement relative to each other. In the illustrated arrangement, the upper plate 356 comprises mounting apertures 358 and the lower plate also comprises mounting apertures 359. The mounting apertures 358, 359 accept mounting hardware 360. Any suitable mounting hardware 360 can be used, including but not limited to pins, nuts, bolts, washers, screws, rivets, other threaded members, other interlocking mechanical members or the like. Furthermore, the upper plate 356 can be integrated with the foot deck 400 and the lower plate can be integrated with the spring board deck 300. In some arrangements, the rotational bearing system 350 can comprise slewing ring bearings or the like.

Figure 3:
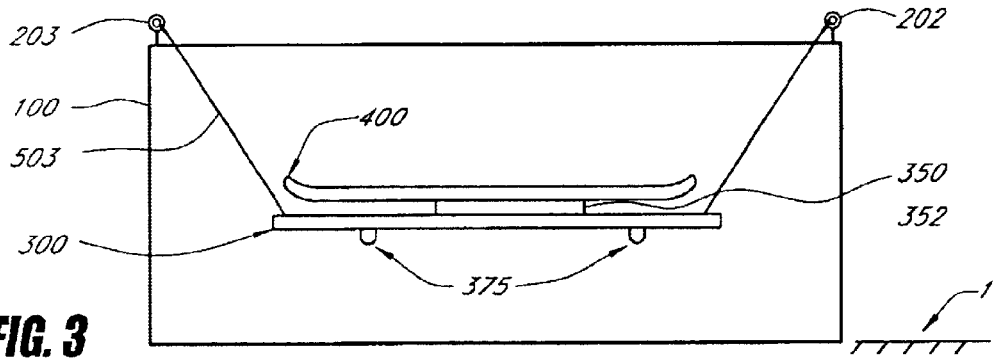
FIG. 3 is a side elevation view of the device of FIG. 1.
Figure 4:
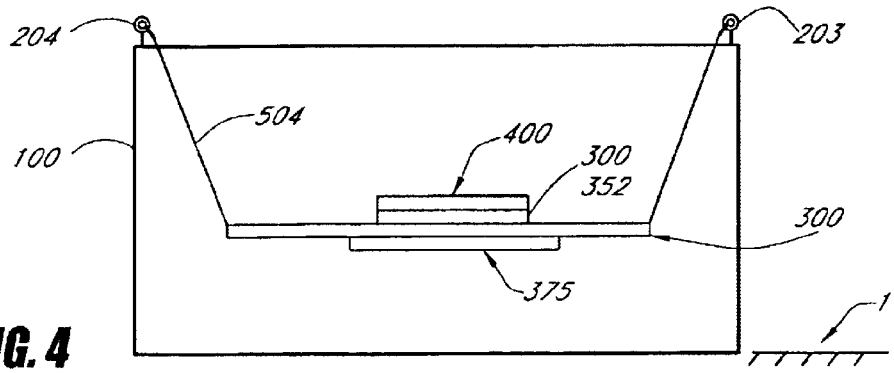
FIG. 4 is a front elevation view of the device of FIG. 1.

With reference to FIG. 3, a wheel/truck simulator 375 can be secured to a lower surface of the spring board deck 300. The simulator 375 can be located beneath the spring board deck 400 in a position that generally corresponds to the placement of wheels and trucks on a skateboard. The wheel/truck simulator 375 need not comprise wheels or any rotating components. In some embodiments, the simulator 375 comprises a pair of monolithic structures that can be secured to the spring board deck 300. In other embodiments, the simulator 375 is integrated into the spring board deck 300 such that the deck 300 and the simulator 375 are monolithically manufactured. The wheel/truck simulator 375 also can comprise a flattened surface such that the foot deck 300 will not tilt in a lateral direction (e.g., left and right or the short dimension of the foot deck 300) when a user is standing on the foot deck 300 with the simulator 375 contacting the ground.

Figure 8:
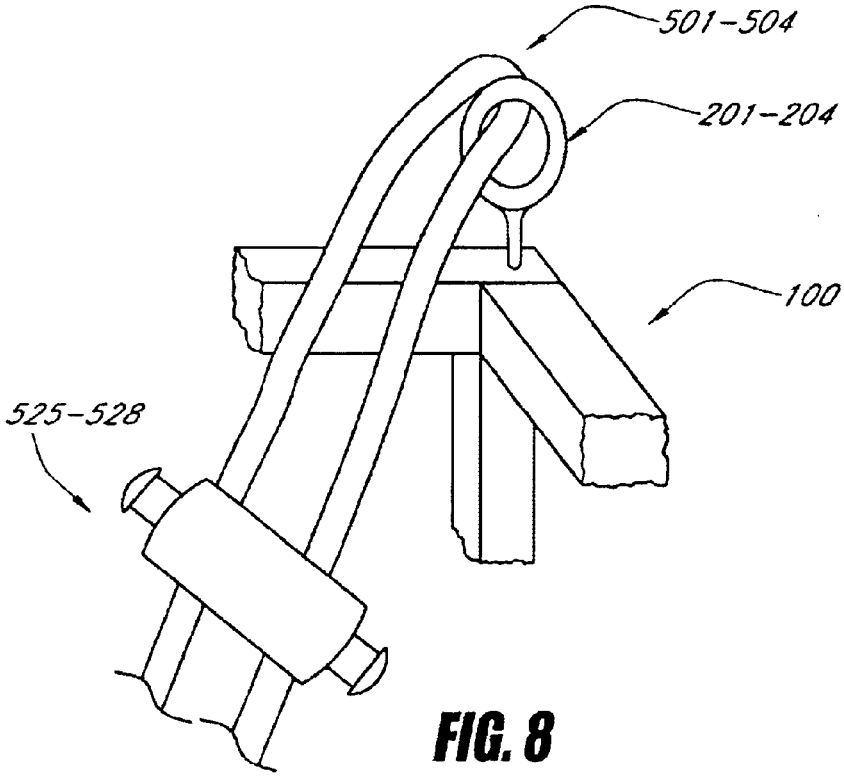
FIG. 8 is a partial perspective view of an elastic cord clamp.
Figure 9:
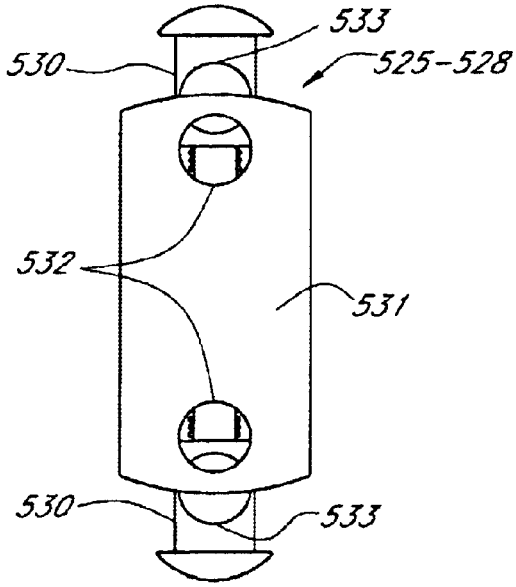
FIG. 9 is a front elevation view of the elastic cord clamp of FIG. 8.

With reference now to FIGS. 8 9, the elastic cords 501–504 can be connected to one or more elastic cord length adjustment clamps 525–528. In the illustrated arrangement, each of the elastic cords 501–504 is connected to a corresponding adjustment clamp 525–528. In some embodiments, less than all of the elastic cords 501–504 is provided with the adjustment clamp 525–528. The adjustment clamps 525–528 allow the length of the cords 501–504 to be adjusted as needed or desired such that the training device can be reconfigured for different sizes of users. In other words, a lighter user may not weigh enough to fully lower the spring board deck 300 to the desired elevation while a heavy user may weight too much to fully benefit from use of the training device 98. Accordingly, enabling adjustment of the lengths of the cords can allow a user to tune the device to their weight and skateboard riding ability.

The clamps can comprise any suitable configuration. In the illustrated arrangement, the clamps 525–528 comprise a pair of biased cord locks 530. The locks 530 are partially captured within a housing 531. The housing 531 comprises a pair of passageways 532 that extend radially through the housing 531. Each lock 530 comprises a similarly sized passageway 533 that can be aligned with the housing passageways 532 by depressing the locks 530 until the passageways 532, 533 are properly aligned. The cord length then can be adjusted and, when the lock 530 is released, the locks return toward a biased position that causes the cord to be locked in position as the passageways misalign. In some embodiments, turnbuckles, turnouts, tie downs, cable locks, cord locks, cord stoppers or the like also can be used.

Figure 10:
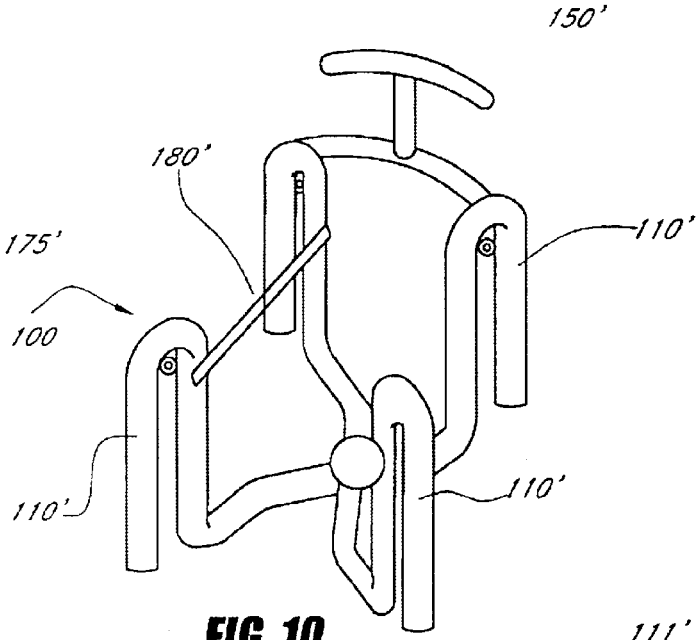
FIG. 10 is a perspective view of an embodiment of a frame used with a training device.
Figure 13:
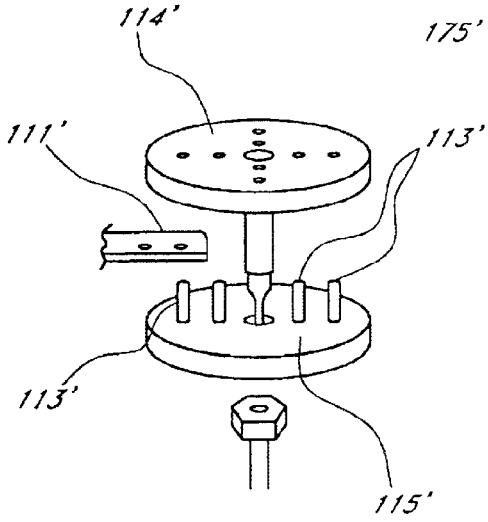
FIG. 13 is a perspective view of a frame clamp used with the frame shown in FIG. 10.

With reference to FIG. 10, a collapsible frame 100' is illustrated. The frame 110' preferably comprises at least 3 legs 110'. In the illustrated embodiment, the frame 110' comprises four legs 110'. The legs 110' can be secured with a frame lock clamp 175'. One possible configuration of the frame lock clamp is shown in FIG. 13.

Figure 11:
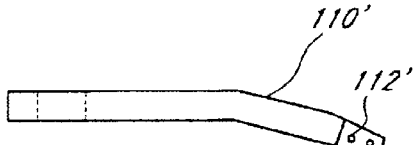
FIG. 11 is a top plan view of a frame leg of the frame shown in FIG. 10.
Figure 12:
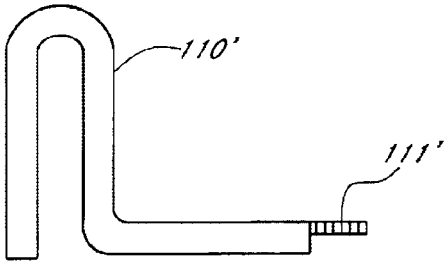
FIG. 12 is a side elevation view of the frame leg of FIG. 11.

With reference to FIGS. 11 and 12, each leg 110' preferably comprises a flange 111' with at least two holes 112'. The flange 111' of each leg 110' is designed to be secured together with the other flanges in the illustrated arrangement with the frame lock clamp 175'. Accordingly, the illustrated frame lock clamp comprises a plurality of pin pairs 113' that are accepted by the holes 112' of the flanges 111'. The pin pairs 113' can be mounted to one of an upper member 114' and a lower member 115'. The upper and lower members 114', 115' can be joined with suitable hardware, such as but not limited to, pins, nuts, bolts, screws, other threaded members, other mechanically interlocking members or the like.

In the illustrated arrangement, the flanges 111' are sandwiched between the upper member 114' and the lower member 115' such that the legs 110' are secured together by the frame lock clamp 175'. Furthermore, the frame lock clamp 175' allows the legs 110' to lock into position when the product is in use and to be unclamped for storage. Other suitable manners of connecting the legs 110' also can be used.

With reference again to FIG. 10, as discussed above, the handle bar 150' can be connected to the frame 100'. Furthermore, a grinding bar 180' can be secured to the frame 100' in any suitable manner. The grinding bar 180' advantageously allows a user to practice mounting and dismounting a grinding rail. The grinding bar 180' preferably is elevated above the ground surface 1' at a height that requires some effort to raise the foot board 400 to a height to land on the grinding bar 180'.

Figure 14:
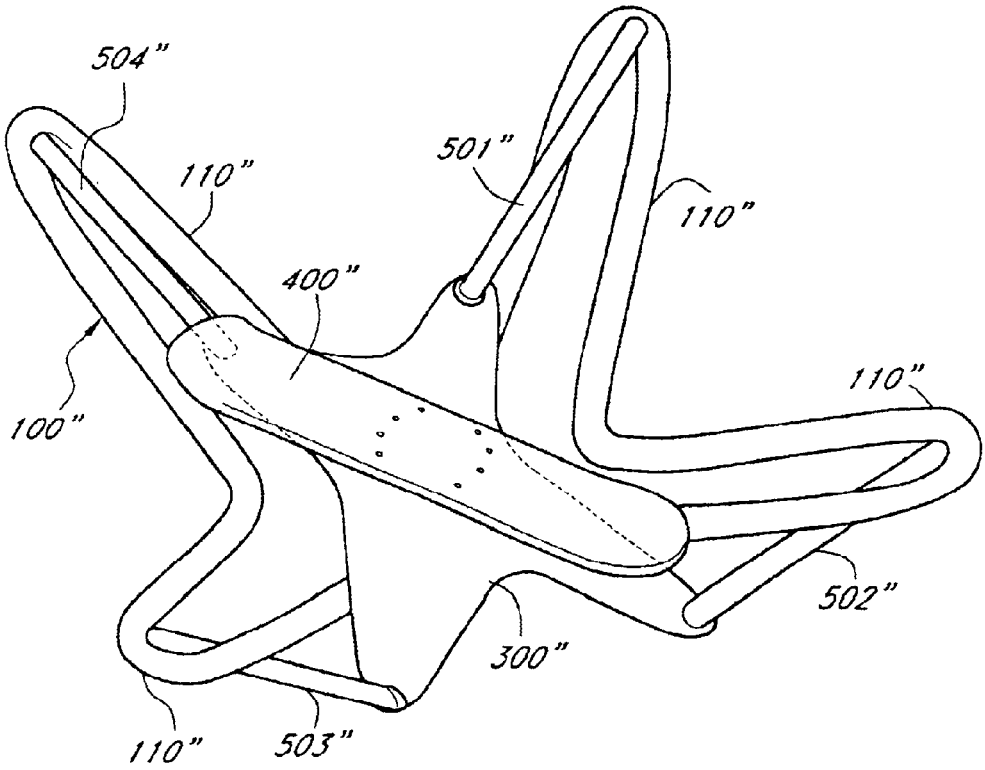
FIG. 14 is a top perspective view of another embodiment of a training device having certain features, aspects and advantages of the present invention.
Figure 15:
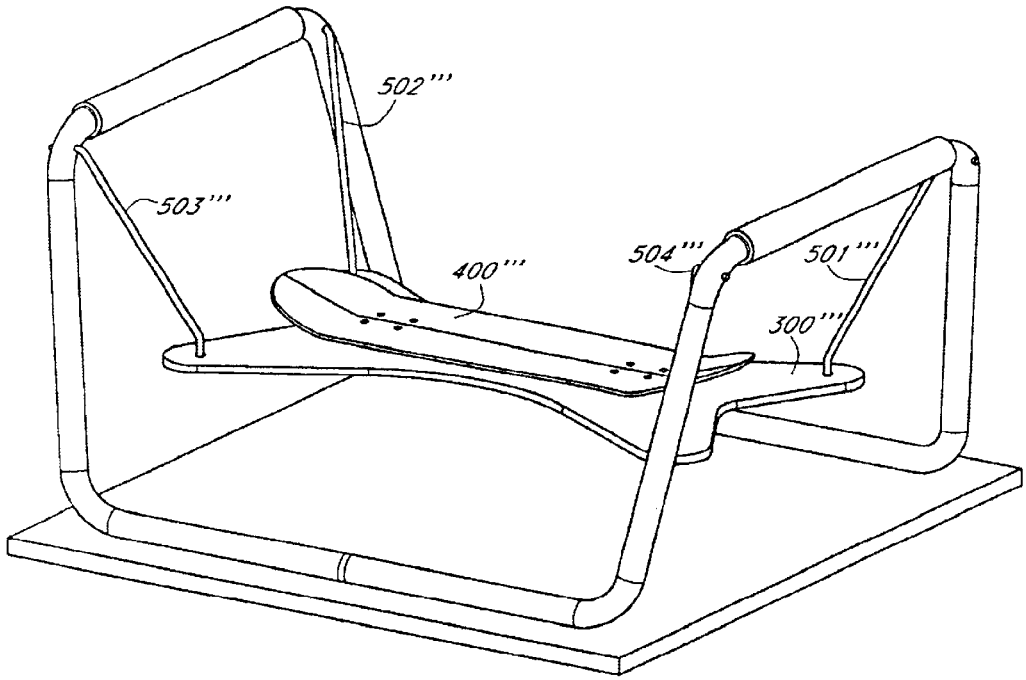
FIG. 15 is a top perspective view of a further embodiment of a training device having certain features, aspects and advantages of the present invention.
Figure 16:
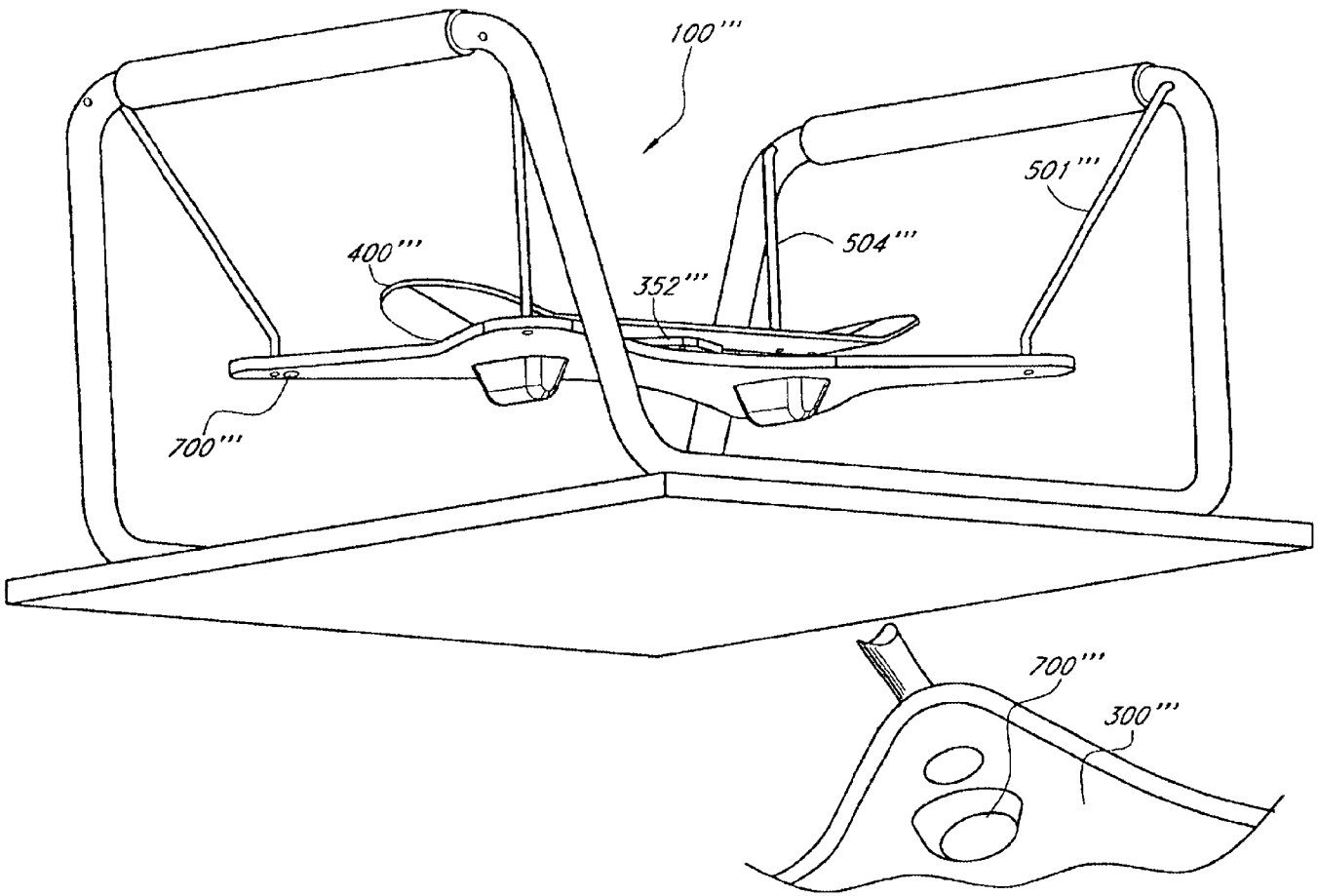
FIG. 16 is a bottom perspective view of the training device of FIG. 15 with an enlarged portion showing a platform mounting configuration.

With reference now to FIG. 14 and FIGS. 15–16, two alternative frame designs are illustrated therein. The frame designs can be configured from suitable tubular members. In some embodiments, the tubular members can comprise steel, aluminum or other suitable metal alloys. Furthermore, the tubular members can be formed of plastics, carbon fiber or any other suitable materials. The tubular members can be connected in the manners discussed above or any other suitable manner.

With reference now to FIG. 14, the frame 100" comprises four elongated generally U-shaped legs 110". The legs 110" can be secured together with hardware, such as that described above. Furthermore, the legs 110" of the illustrated frame can be linked together using a sleeve within a sleeve arrangement where one end of a frame member slides within an end of an adjacent frame member. Other suitable connecting techniques also can be used.

The cords 501"–504" can be connected to the frame 100" in any suitable manner. The cords can be configured of any suitable material. In one embodiment, the cords 501"–504" can comprise a rubberized cover that is disposed over a small diameter bungee cord-like rope. Other types of elastic, resilient or stretchable cords also can be used.

The illustrated spring board deck 300" can be formed in any suitable manner of any suitable material. In one embodiment, the deck 300" is molded from a suitable resin based material. In another embodiment, the 300" is made of a thin wood or metal material. In addition, the illustrated foot deck 400' can be formed in any suitable manner of any suitable material. For instance, in one embodiment, the deck 400" can be formed of a clear acrylic material. In another embodiment, the deck 400" can be formed of a wood or metal material.

With reference now to FIGS. 15 and 16, the frame 100"' can comprise a hammock-style support. Furthermore, the cords 501"'–504"' can be connected to the spring board deck 300"' in any suitable manner. In the illustrated embodiment, caps 700"' are used to lock the cords to a lower surface of the deck 300"'.

In operation of any of the above-described embodiments, the foot deck and the spring board deck assembly is suspended by the elastic cords above the ground and below the top of the frame. The user then steps onto the foot deck, and the user's weight stretches the elastic cords and the foot deck and spring board deck assembly preferably touches the ground. From this position, the user may practice and perform various tricks and maneuvers. The user may pitch the board like a skateboard and learn this motion and balance without having a tilting motion to the foot deck. The user may pivot the board on the rotational bearing system located at the center of the deck, to help the user learn balance skills while on the foot deck. The user may jump up to remove weight from the foot deck, and learn to articulate the foot deck as it is lifted off the ground by the spring force provided by the stretched elastic cords. The user may also learn to land on the foot deck and learn overall balance techniques in the process of landing and bringing the foot deck system back to the ground. The user may also jump up, allowing the elastic cord spring load to lift the foot deck, and articulate and rotate the foot deck, to land on the grinding bar and then balance the foot deck on the grinding bar. The user may also combine any one or all of these motions to learn more advanced skills to perform tricks and maneuvers. The user may also hold the handle bar for balance while using the device. The user may also unlock and collapse the frame into a compact storage configuration when the product is not in use.

Although the present invention has been described in terms of certain preferred embodiments, other embodiments apparent to those of ordinary skill in the art also are within the scope of this invention. Thus, various changes and modifications may be made without departing from the spirit and scope of the invention. For instance, various components may be repositioned as desired. Furthermore, aspects of one illustrated embodiment can be applied to other illustrated embodiments. For instance, the grind rail 180' can be used with any of the disclosed frames. Moreover, not all of the features, aspects and advantages of any particular embodiment are necessarily required to practice the present invention. Accordingly, the scope of the present invention is intended to be defined only by the claims that follow.

What is claimed is:

1. A device for mastering skate board tricks and maneuvers comprising a frame, said frame comprising a top and said frame being adapted to rest on a support surface, at least three elastic cords being attached to said frame; said at least three elastic cords being connected to a spring board deck such that said spring board deck is suspended above said support surface and below said top of said frame; a rotational bearing system being secured to said spring board deck and a foot deck being secured to the said rotational bearing system such that said foot deck is capable of rotational movement relative to said spring board deck and said foot deck is secured against substantial vertical movement relative to said spring board deck.

2. The device of claim 1 further comprising at least two protrusions connected to a lower surface of said spring board deck, said protrusions being sized to simulate the geometry of skateboard trucks and wheels and said protrusions being arranged such that each protrusion creates a line contact with said support surface.

3. The device of claim 1, wherein said frame comprises at least three support legs, said at least three support legs being temporarily secured together such that said frame can be collapsed for storage.

4. The device of claim 1, wherein with said elastic cords are at least one of (1) removably attached to said frame and (2) removably connected to said spring board deck.

5. The device of claim 1, wherein said rotational bearing system comprises an adapter, said adapter being disposed between said foot deck and a balance of said rotational bearing system.

6. The device of claim 1, wherein said frame comprises a handlebar.

7. The device of claim 1 further comprising a plurality of cord anchors, said cord anchors being interposed between said at least three elastic cords and said frame.

8. The device of claim 7, wherein at least one cord adjustment clamp is connected to at least one of said at least three cords.

* * * * *